US005231729A

United States Patent [19]

Rose

[11] Patent Number: 5,231,729

[45] Date of Patent: Aug. 3, 1993

[54] TILING TROWEL

[76] Inventor: Derrick D. Rose, 9 Pickering House, Woodbury Down Estate, London, England, N4

[21] Appl. No.: 882,245

[22] Filed: May 8, 1992

Related U.S. Application Data

[63] Continuation of Ser. No. 694,811, May 2, 1991, abandoned.

[30] Foreign Application Priority Data

May 4, 1990 [GB] United Kingdom ..... 9010144

[51] Int. Cl.[5] ..... B05C 17/10; B05C 11/04

[52] U.S. Cl. ..... 15/235.4; 15/235.8; 15/145

[58] Field of Search ..... 15/104.5, 145, 176, 15/235.4, 235.6, 235.8, 244 R

[56] References Cited

U.S. PATENT DOCUMENTS

| | | | |
|---|---|---|---|
| 2,167,996 | 8/1939 | Pritz | 15/104.5 |
| 2,824,330 | 2/1958 | Williams | 15/235.6 |
| 3,023,444 | 3/1962 | Tims, Jr. | 15/235.6 |
| 3,916,472 | 11/1975 | Carder | 15/104.5 |
| 4,316,302 | 2/1982 | Clark | 15/104.5 |
| 4,958,399 | 9/1990 | Toal et al. | 15/104.5 |

FOREIGN PATENT DOCUMENTS

| | | | |
|---|---|---|---|
| 206933 | 10/1940 | Fed. Rep. of Germany | 15/236.08 |
| 941627 | 11/1963 | United Kingdom | 15/104.5 |
| 1318493 | 5/1973 | United Kingdom | 15/235.4 |

*Primary Examiner*—Harvey C. Hornsby
*Assistant Examiner*—Patrick F. Brinson
*Attorney, Agent, or Firm*—Foley & Lardner

[57] ABSTRACT

A tilers trowel having at least one edge which is notched and wherein adjustment means is provided for limiting the depth of material which can be applied, i.e. by adjusting the size of the notching. In one embodiment the trowel comprises two plate-like members which are cooperable and adjustable slidably with respect to one another. One or both members may have notching and preferably the plate members are rectangular with notching to all four edges. A handle is secured to one plate member.

9 Claims, 4 Drawing Sheets

TILING TROWEL

This is a continuation of application Ser. No. 07/694,811 filed May 2, 1991 abandoned.

BACKGROUND OF THE INVENTION

This invention relates to a tiling trowel. Tilers use a notched trowel to apply adhesive to a surface. Depending upon the surface and the type of tile or vinyl used, a different depth of adhesive is required. To accomodate this the tiler needs a series of trowels with different notch sizes for the different jobs. The need for several different sizes is disadvantageous.

It is an aim of the present invention to overcome this disadvantage.

SUMMARY OF THE INVENTION

According to the present invention there is provided a trowel having at least one edge provided with adjustable means for limiting the depth of material which can be applied to a surface.

Said edge and adjusting means is preferably consituted by mutually cooperable members mounted for movement with respect to one another (preferably slidable movement) conveniently at least one of said member is notched, wherein movement of the members relative to one another varies the effective depth of the notching and hence the depth of material applied. In one embodiment both members are notched. The members preferably comprise two plate like members which may be substantially rectangular.

For practical purposes it is advantageous if all four edges of the trowel are notched, and advantageously with two or more different sizes of notch available simultaneously for different tasks. Notches may be rectangular, V-shaped or in any other convenient shape, with sizes and shapes combined as required. The notching may be in a part of the trowel fixed with respect to a handle of the trowel and/or in a movable part.

A notched blade construction may be combined with slidably adjustable depth gauges, thereby providing a further means of adjusting the depth of material applied.

The means for limiting the depth of material applied could be adjustable to discrete settings but are preferably adjustable continuously over a range for flexibility of use. The slidable adjusting means are preferably provided with fixing means to prevent slippage once the desired limit has been set for the material depth.

BRIEF DESCRIPTION OF THE DRAWINGS

The present invention will now be described further, by way of example only, with reference to the accompanying drawings, in which.

DESCRIPTION OF THE PREFERRED EMBODIMENTS

Figure 1:
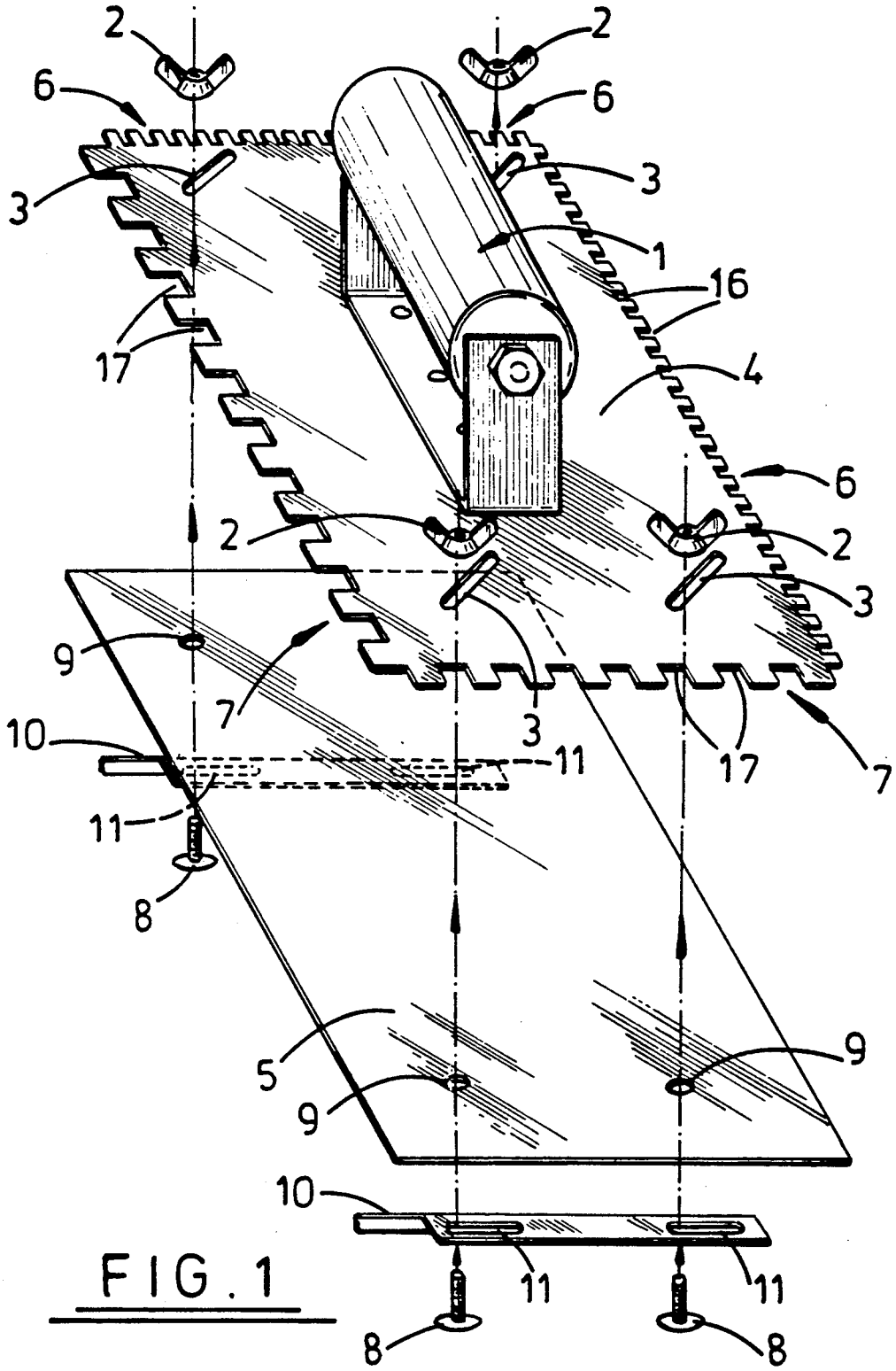
FIG. 1 is an exploded perspective view of a trowel according to one embodiment of the invention.

A first embodiment of the invention is shown in FIGS. 1–4. A tiler's trowel for applying adhesive comprises an upper plate 4 having a handle 1, and a lower plate 5 securable thereto. Two adjacent edges 7 of the upper plate are provided with large rectangular notches 17 for laying ceramic floor tiles, and two adjacent edges 6 are provided with smaller rectangular notches 16 suitable for ceramic wall tiles. The lower plate 5 is without notching.

The upper plate 4 is provided with diagonal slots 3. The lower plate 5 has corresponding smaller holes 9. When assembled the holes 9 in the lower plate 5 and the slots 3 in the upper plate 4 are aligned and loosely held by screws 8 and wing nuts 2. Then depth of notch revealed by the plate 4 and 5 can be adjusted by means of sliding the plates relative to one another with the screws 8 able to travel along the slots 3, while remaining substantially stationary relative to the holes 9. When the desired depth of notch is reached the wing nuts 2 are tightened into place to fix the plates.

Depth gauges 10 are securable to the lower plate 5, said depth gauges being provided with slots 11 for taking the fixing means passing through holes 9 in the lower plate. The length of a depth gauge 10 is adjusted by sliding relative to plate 5 with the screws 8 travelling along the slots 11. Wing nuts 2 are tightened to fix the gauges.

Figure 2:
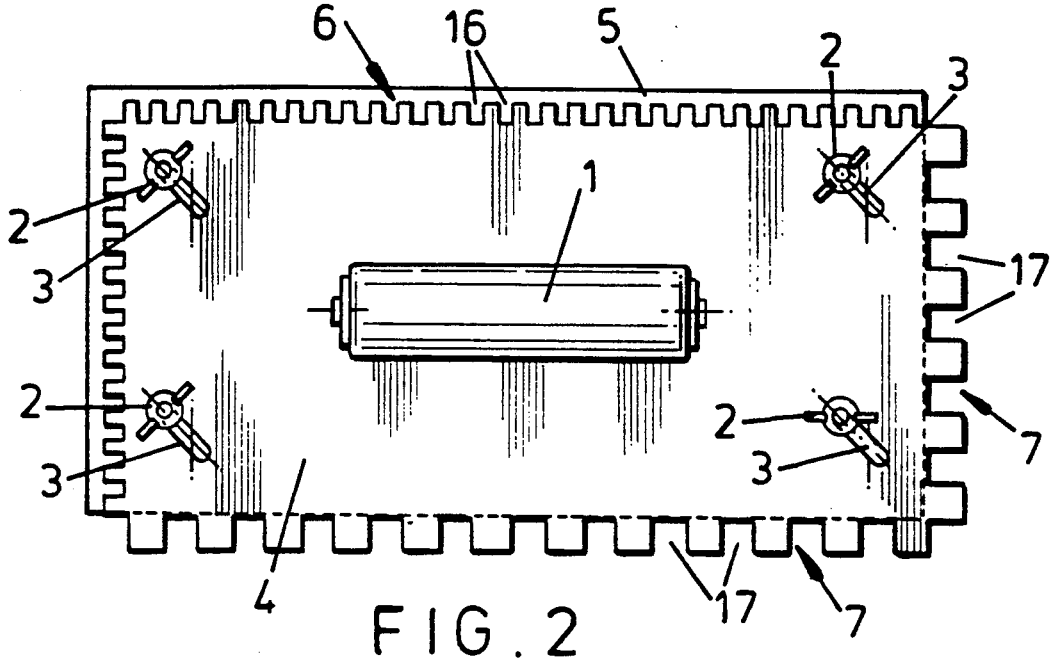
FIGS. 2, 3 and 4 are plan views of the trowel of FIG. 1 shown adjusted to produce different depths of adhesive.

FIG. 2 shows an extreme position of the adjusting means with fixing means located at the end of the slots 3. The plates are set to show the entirety of notches 17 on the edges 7, suitable for a thick adhesive bed.

Figure 3:
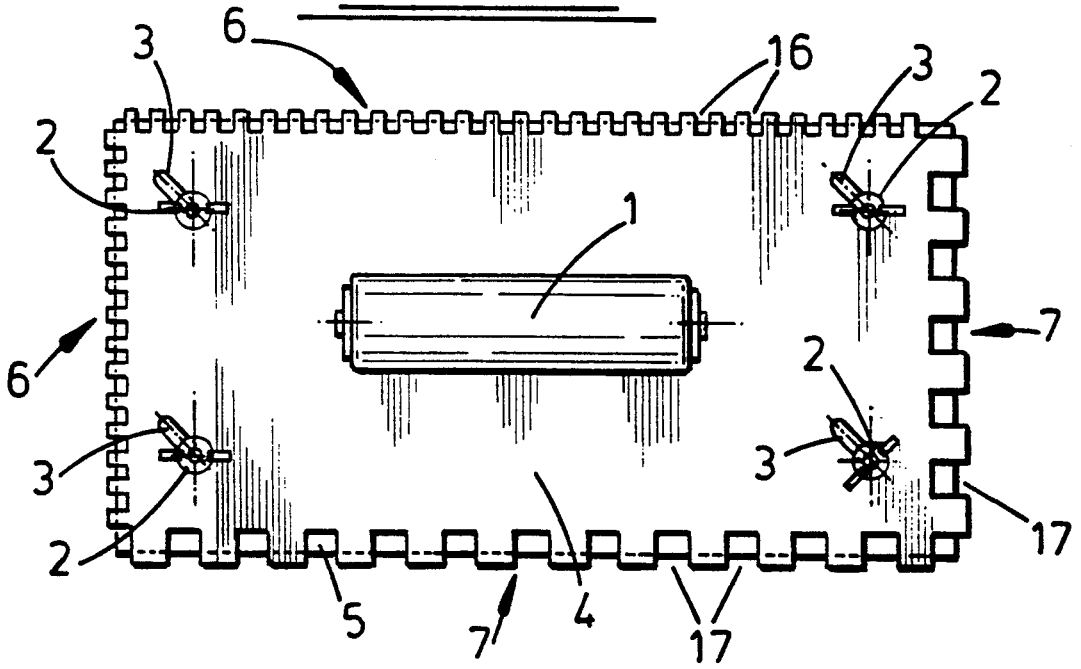

FIG. 3 shows an intermediate adjustment where the fixing means are in a middle part of the slots 3 so that both notches 17 and 16 are made effectively smaller by plate 5, to provide a shallower depth of adhesive.

Figure 4:
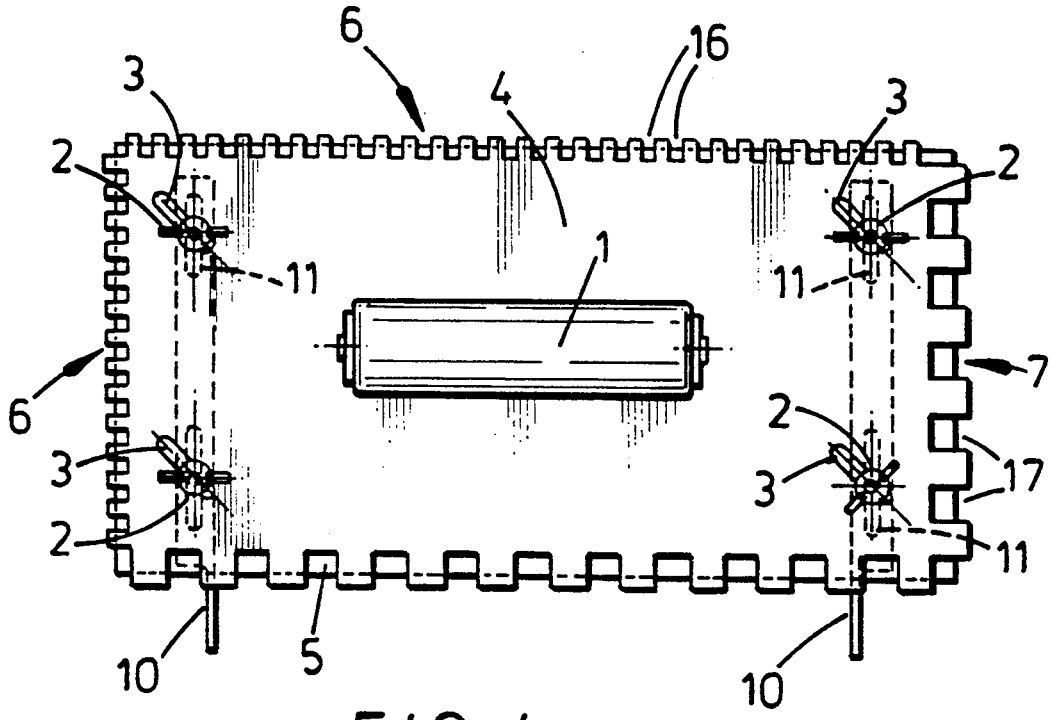

FIG. 4 shows detachable depth gauges 10 fixed to plate 5 and protruding from the trowel edge to provide a very thick adhesive bed.

Although in this example the upper plate has notched edge it will be understood that the trowel could have straight edges on the upper plate with the lower plate notched along its edge or edges.

Figure 5:
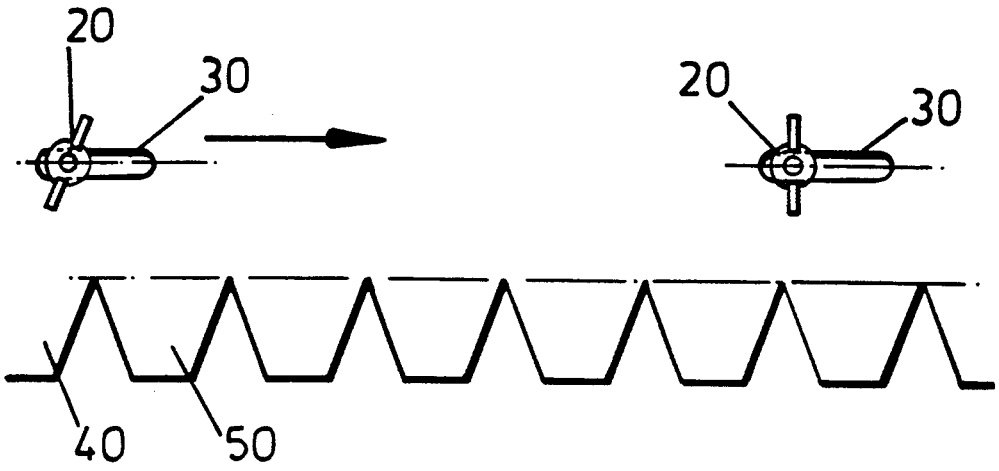
FIGS. 5 and 6 are fragmentary plan views of an edge of a trowel according to a second embodiment of the invention.
Figure 6:
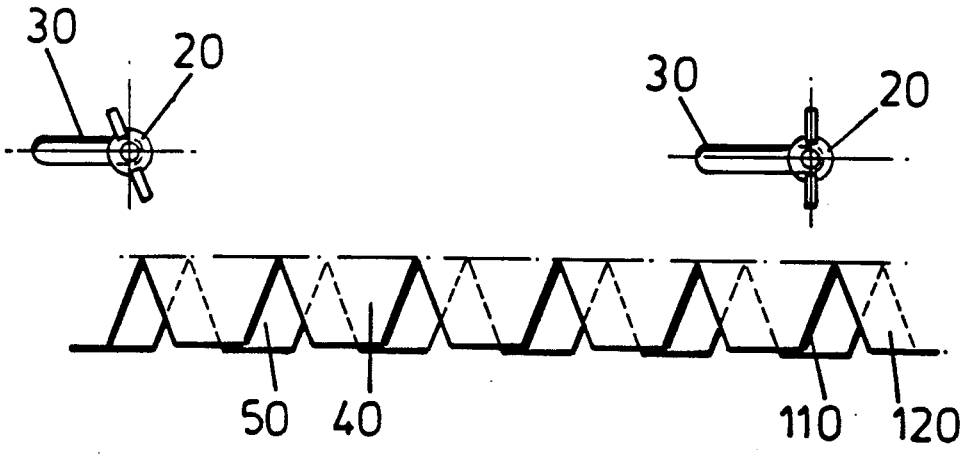

In a second embodiment shown in FIGS. 5 and 6, the trowel has V-shaped notches and the adhesive depth is adjustable by using two notched plates 40, 50 with equal size notches 110 and 120 respectively. Here slots 30 are horizontal to the trowel edges. Adjustment occurs as before by way of loosely held screws which pass through holes in the lower plate 50 and move along slots 30 in the upper plate, covering the plates to move relative to one another. FIG. 5 shows one extreme of the range of adjustment, notches 110 and 120 in lower and upper plates coincide to give a thick bed of adhesive. FIG. 6 shows the notches 110 and 120 off set making a smaller effective notch size.

In the illustrated embodiments, four slots are provided, but an alternative, especially where the additional depth gauge is disposed with, is to have two slots positioned, say in alignment with the handle, and to opposite sides thereof.

We claim:

1. A trowel for applying material, e.g., tiling adhesive, to a surface, the trowel having a plurality of edges and adjustable means associated with said edges for limiting the depth of material which can be applied to a surface, said edges and adjustable means comprising mutually cooperable and slidingly coupled plate-like members, means for moving one of the plate-like members diagonally with respect to the other plate-like member, notches having uniform depth provided along two mutually adjacent edges on one of said plates, whereby movement of one of said members with respect to the other serves to vary the depth of the notches simultaneously along said mutual adjacent edges while maintaining a uniform notch depth along the two mutually adjacent edges.

2. A trowel according to claim 1 in which both members are notched.

3. A trowel according to claim 1 in which two or more different sizes of notch are available simultaneously to respective edges.

4. A trowel according to claim 1 having four edges and in which all the edges are notched.

5. A trowel according to claim 1 in which the two plate-like members are rectangular.

6. A trowel according to claim 1 in which one of the members is fixed with respect to a handle of the trowel.

7. A trowel according to claim 1 in which the members are slidable with respect to one another and clamp means is provided for selectably locating the two members with respect to one another to set the maximum depth of material which may be applied.

8. A trowel according to claim 7 in which the direction of slidable movement of the two plate members for adjustment is angled with respect to at least one edge of the trowel.

9. A trowel according to claim 1, wherein the notches on the adjacent edges are the same shape, and adjustment of the notch depth maintains the same size notch on said adjacent edges.

* * * * *